US005701613A

United States Patent [19]

Richardson

[11] Patent Number: 5,701,613

[45] Date of Patent: Dec. 30, 1997

[54] SWIMMING POOL COVER ASSEMBLY

[76] Inventor: Cedric D. Richardson, 1401 Redford Apt. 1302-B, Houston, Tex. 77034

[21] Appl. No.: 577,702

[22] Filed: Dec. 22, 1995

[51] Int. Cl.[6] ..... E04H 4/00

[52] U.S. Cl. ..... 4/502; 160/133

[58] Field of Search ..... 4/498, 502, 608; 160/133, 199, 206

[56] References Cited

U.S. PATENT DOCUMENTS

| | | | |
|---|---|---|---|
| 1,060,132 | 4/1913 | Schaefer | 160/206 |
| 2,460,157 | 1/1949 | Watkins | 160/199 X |
| 2,754,899 | 7/1956 | Karobonik et al. | 4/502 X |
| 3,076,975 | 2/1963 | Lamb | 4/502 |
| 3,613,126 | 10/1971 | Granderath | 4/502 |
| 5,425,143 | 6/1995 | Kolandorsky | 4/502 |
| 5,472,037 | 12/1995 | Hoffman | 160/199 X |

FOREIGN PATENT DOCUMENTS

| | | | |
|---|---|---|---|
| 2507656 | 12/1982 | France | 4/502 |
| 2506816 | 12/1986 | France | 4/498 |
| 3813645 | 8/1989 | Germany | 4/498 |
| 0675892 | 11/1990 | Switzerland | 4/498 |

*Primary Examiner*—Charles E. Phillips
*Attorney, Agent, or Firm*—Pravel, Hewitt, Kimball & Krieger

[57] ABSTRACT

A roll-up cover for a swimming pool comprises a continuous sheet of flexible reinforced plastic firmly attached to an aluminum roller with a number of reinforced loops at the free end of the plastic. The roller can be turned by a crank or wheel to roll the cover up, and a pull with a hooked end is used to unroll the cover by inserting it into one of the reinforced loops and pulling the cover off of the roller. The loop straps on the free end of the cover can be hooked at the end of the pull to keep the cover tight. The entire cover assembly is mounted on wheels so that it is of a portable construction, and it includes a debris removal and collection apparatus. The cover can be made of a plurality of interleaved pivotally connected members which is movable along the edges of a swimming pool by a plurality of rollers, and the cover is strong enough to support an adult or child in the event that they accidentally fall into the pool.

13 Claims, 3 Drawing Sheets

SWIMMING POOL COVER ASSEMBLY

BACKGROUND OF THE INVENTION

1. Field of the Invention

The present invention relates to swimming pool covers and more particularly pertains to a pool cover which can be easily stored on and removed from a portable roller assembly.

2. Description of the Prior Art

The use of swimming pool covers is well known in the prior art. This is evidenced by the granting of a number of patents relating to various functional and structural aspects of such swimming pool covers, and these covers take all forms and shapes.

One of the biggest problems experienced when utilizing pool covers is how and where to store such covers during periods of non-use. Another problem involves the floatability of such covers. More specifically, pool covers are primarily designed to capture debris which would otherwise float on the pool surface and frequently sink to the bottom of the pool, and to also retain heat in the pool water. Some versions of pool covers include solar collection arrangements wherein the pool cover actually operates to both heat the pool water, while retain the heat that is already present.

None of these prior art pool covers are particularly adapted for supporting the weight of a human being thereon due to the fact that a much more bulky cover would be required so as to increase the floatability to an extent that is could support the weight of an adult who might accidentally fall into the pool. The increased bulkiness would again contribute significantly to the first mentioned problem of how to store a cover during periods of non-use.

With respect to addressing the problem of cover storage, a number of U.S. patents are relevant to the concept of the present invention. For example, U.S. Pat. No. 5,068,928, which issued to Powell on Dec. 3, 1991, discloses an apparatus for storing a rolled pool cover along the exterior sidewall of an above-ground swimming pool. The apparatus includes a plurality of perimetrically spaced-apart, upwardly opening hooks which are canitleverly supported on the pool sidewall, and a rolled pool cover can be supported exteriorly of the pool within the confines of the hooks when not being utilized.

U.S. Pat. No. 5,107,552, which issued to Lavalliere et al. on Apr. 28, 1992, discloses a swimming pool cover and roll-up device. The combination includes a flexible shaft which is positionable across the cover wherein such shaft is permanently attached to the cover, and it may be rolled so as to cause the cover to be rolled thereon from two directions. The entire shaft can then be lifted out of the pool and flexibly deformed to be hung on a plurality of hooks perimetrically aligned around a circular above-ground swimming pool.

Another novel swimming pool cover assembly is shown in U.S. Pat. No. 4,471,500 which issued to Long et at. on Sep. 18, 1984. The cover shown in this patent is of a self-rolling construction which is designed to extend over the water surface of a pool when connected to a pressure source, and it returns to a rolled position when disconnected therefrom. A fluid pressure source, such as water or air, is utilized to extend a rolled conduit, wherein the conduit is retained within the cover and is caused to go into a rolled condition by a permanently installed coil spring arrangement.

U.S. Pat. No. 4,324,370, which issued to Guard et al. on Apr. 13, 1982, is of interest as disclosing another pool cover roller assembly. A roller apparatus for winding and unwinding a pool cover includes a flexible cover which is permanently attached to a roller that can be manually operated to store the cover thereabout, and the entire assembly is mounted on wheels so that it can be removed easily to a desired storage area during periods of non-use. This cover, as well as all of the other covers as above-discussed, is designed to protectively cover the water surface of the pool so as to prevent the accumulation of debris therein, as well as to retain heat within the pool's water. The cover is not bulky or strong enough to serve the function of protecting against child or adult injury in those incidences where they might accidentally fall into the pool inasmuch as the disclosed roll-up structures most likely cannot easily support the increased size of such a cover.

While each of these prior arts patents disclose devices which fulfill their respective particular objectives and requirements, and are most likely quite functional for their intended purposes, none of them have apparently addressed the problem of how to construct a cover of sufficient strength to support the weight of an adult or child who might accidently fall into a pool and as such, there apparently still exists the need for swimming pool cover which would perform this desired function. In this respect, the present invention substantially fulfills this need.

SUMMARY OF THE INVENTION

In view of the foregoing disadvantages inherent in the known types of swimming pool covers now present in the prior art, the present invention provides a new swimming pool cover wherein the same can be utilized to clean and collect debris from a pool, capture or retain heat within the pool's water, and protect against accidental drownings of adults and children. As such, the general purpose of the present invention, which will be described subsequently in greater detail, is to provide a swimming pool cover and method which has many of the advantages of the swimming pool covers mentioned heretofore and many additional novel features that result in a swimming pool cover which is not anticipated, rendered obvious, suggested, or even implied by any of the prior art swimming pool covers, either alone or in any combination thereof.

To attain this, the present invention generally comprises a roll-up cover for a swimming pool comprises a continuous sheet of flexible reinforced plastic firmly attached to an aluminum roller with a number of reinforced loops at the free end of the plastic. The roller can be turned by a crank or wheel to roll the cover up, and a pull with a hooked end is used to unroll the cover by inserting it into one of the reinforced loops and pulling the cover off of the roller. The loop straps on the free end of the cover can be hooked at the end of the pull to keep the cover tight. The entire cover assembly is mounted on wheels so that it is of a portable construction, and it includes a debris removal and collection apparatus. The cover can be made of a plurality of interleaved pivotally connected members which is movable along the edges of a swimming pool by a plurality of rollers, and the cover is strong enough to support an adult or child in the event that they accidentally fall into the pool.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new swimming pool cover and method which has many of the advantages of the swimming pool covers mentioned heretofore and many novel features that result in a swimming pool cover which is not anticipated, rendered obvious, suggested, or even implied by any of the prior art swimming pool covers, either alone or in any combination thereof.

It is another object of the present invention to provide a new swimming pool cover which may be easily and efficiently manufactured and marketed.

It is a further object of the present invention to provide a new swimming pool cover which is of a durable and reliable construction.

An even further object of the present invention is to provide a new swimming pool cover which is susceptible of a low cost of manufacture with regard to both materials and labor, and which accordingly is then susceptible of low prices of sale to the consuming public, thereby making such swimming pool cover economically available to the buying public.

Still yet another object of the present invention is to provide a new swimming pool cover which provides in the apparatuses and methods of the prior art some of the advantages thereof, while simultaneously overcoming some of the disadvantages normally associated therewith.

Still another object of the present invention is to provide a new and improved swimming pool cover which facilitates the use of a cover which performs a cleaning function, a heat retention function, and a protection function against accidental drowning.

Yet another object of the present invention is to provide a new and improved swimming pool cover which provided with sufficient strength to guard against the accidental drowning of children who might accidentally fall into the associated swimming pool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENTS

Figure 1:
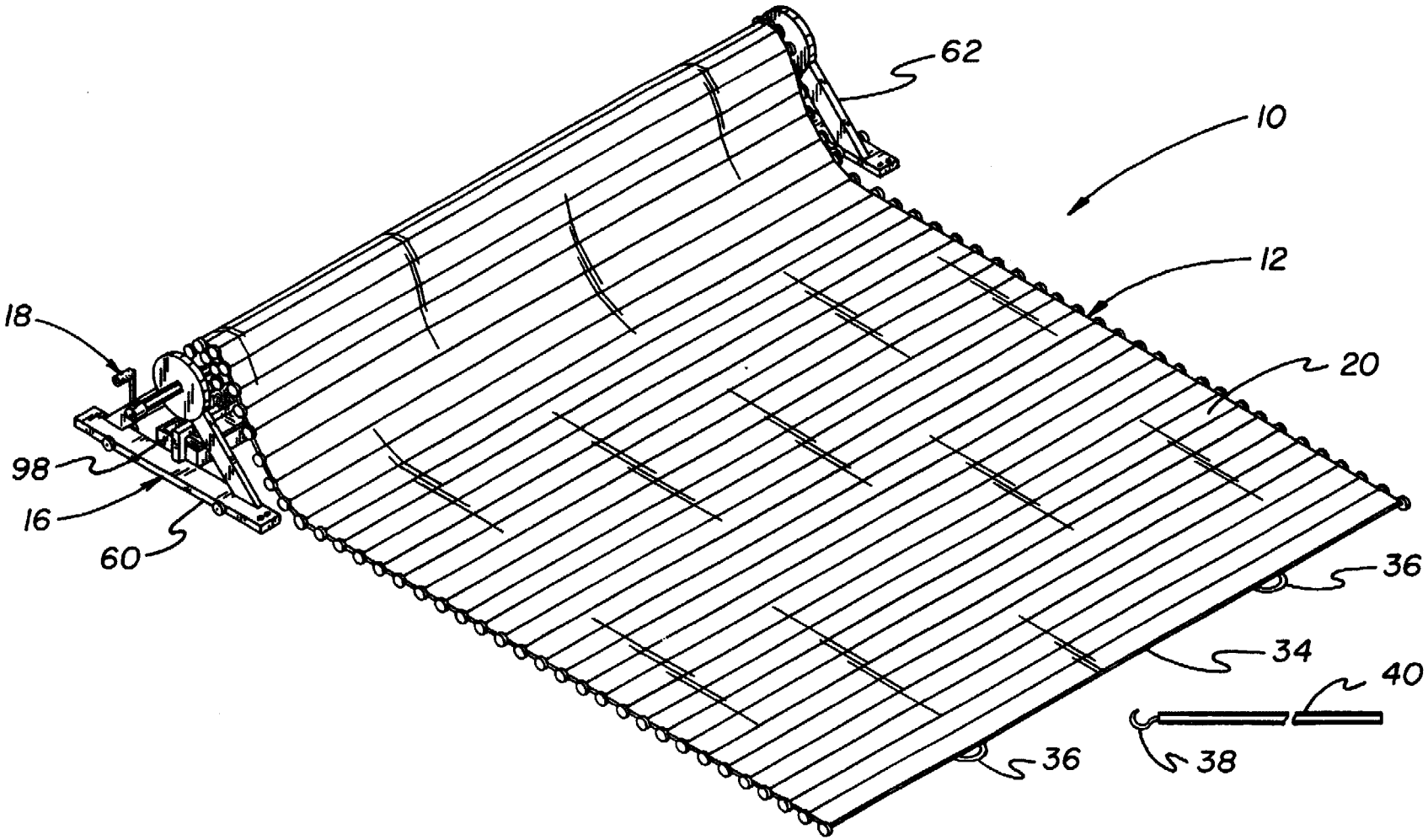
FIG. 1 is a perspective view of the swimming pool cover assembly comprising the present invention.

With reference now to the drawings, and in particular to FIGS. 1–4 thereof, a new swimming pool cover embodying the principles and concepts of the present invention and generally designated by the reference numeral 10 will be described.

More specifically, it will be noted that the swimming pool cover assembly 10 essentially comprises a flexible cover 12 attached to an elongated roller 14 which in turn is rotatably mounted to a portable support structure 16 with a handle structure 18 being operable to effect a desired rotation of the roller.

Figure 3:
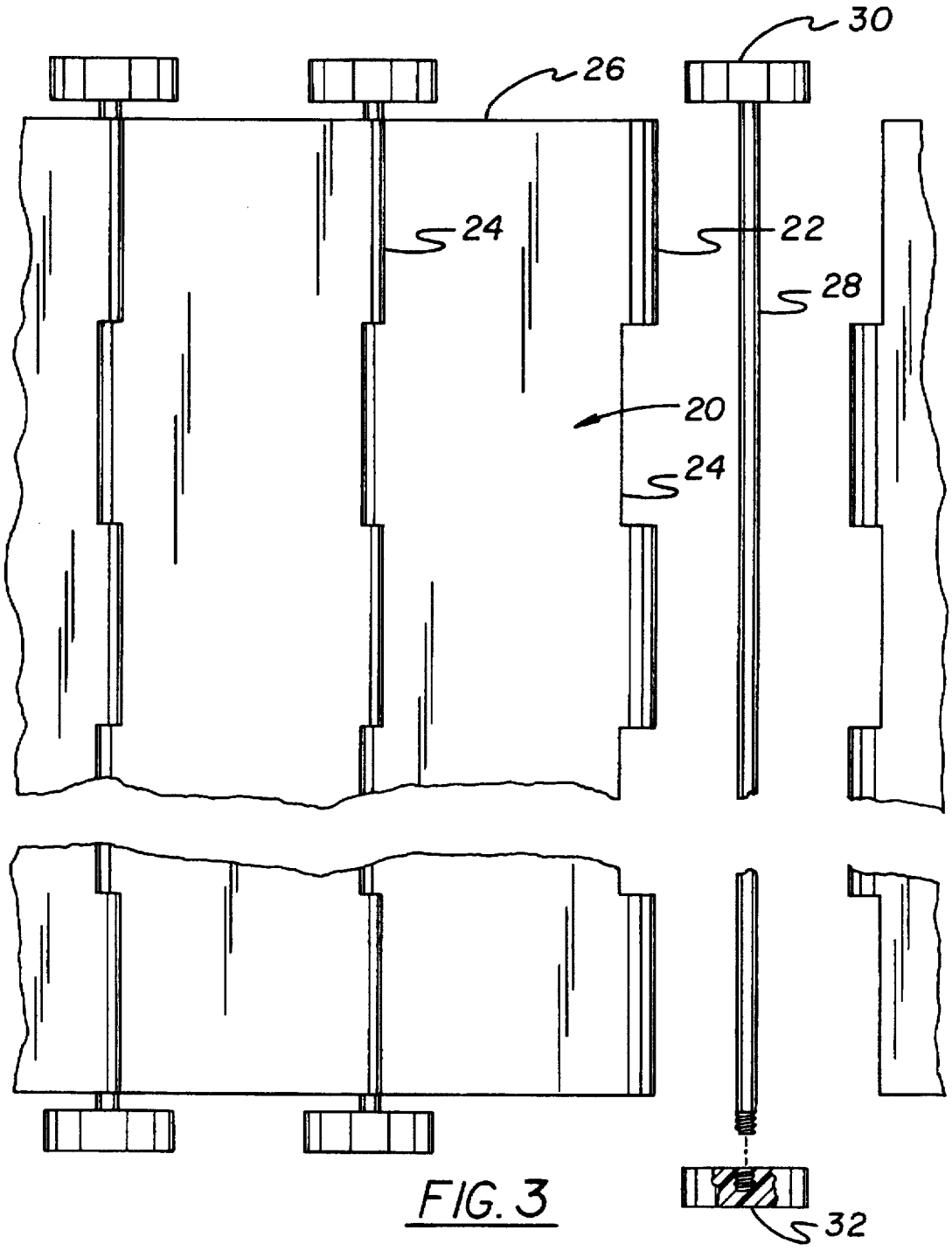
FIG. 3 is a partial top plan view of the cover forming a part of the invention.
Figure 4:
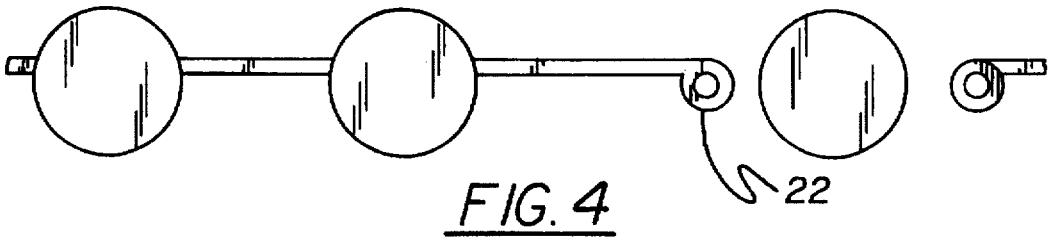
FIG. 4 is a partial exploded side elevation view of the cover.

The flexible cover 12 would be specially designed for each swimming pool, and could be made in a variety of sizes and shapes to fit most pools with standard shapes, including circles, squares, rectangles, ovals, and combinations of all of these. As shown, in the preferred embodiment 10, the flexible pool cover 12 is constructed of a plurality of interleaved slats 20 which are pivotally connected together to form the composite cover. As best illustrated in FIGS. 3 and 4, each slat 20 is provided with a series of integral conduits 22 on opposed sides thereof. These conduits 22 are spaced apart at equal lengths, and each space 24 is equal in length to a conduit 22. As shown in FIG. 3, the conduits 22 are integrally formed in a staggered array, whereby at an end 26 of a slat 22, one side of the slat begins with a conduit 22 and the opposed side begins with a space 24. This facilitates the inner engagement of conduits 22 between slats 20 so that an elongated hinge rod 28 can be inserted through the aligned openings of the interengaged conduits thereby to effectively hingedly attach the slats 20 together in a now apparent manner. The hinge rod 28 would be of a lightweight metal construction so as to impart strength to the slats 20 and wheels 30, 32 would be threadably attached to opposed ends of the hinge rod 28 so as to provide a mobility to the cover 12 as it is pulled along the edges of a swimming pool. In the preferred embodiment 10, the slats 20 could be formed of a flexible reinforced plastic, again to hold the accumulative weight down, and the hinge rods 28 then provide a strengthening reinforcement so that the cover could support the weight of an adult who might accidentally fall onto the cover while it is positioned over the surface of a swimming pool. The wheels 30, 32 would travel along the supporting edge of the pool and, in the case of a specially designed pool, the wheels could be operably retained within a receiving groove along the edge of the pool to further add support to the cover in the event of a child or adult falling thereon.

A free end 34 of the flexible pool cover 12 is provided with a plurality of reinforced loop straps 36. These loops may be engaged by a hook 38 attached to an elongated pole 40, and a user may employ the pole to pull the cover 12 off of the elongated roller 14 so as to effectively cover the surface of the swimming pool. Once the cover 12 reaches the end of the pool so as to substantially cover the entire surface thereof, the loop straps 36 may be attached to connectors which are permanently affixed to an end of the pool, thereby to retain the cover 12 in a secured position over the pool inasmuch as the other end of the cover is fixedly secured to the elongated roller 14.

Figure 2:
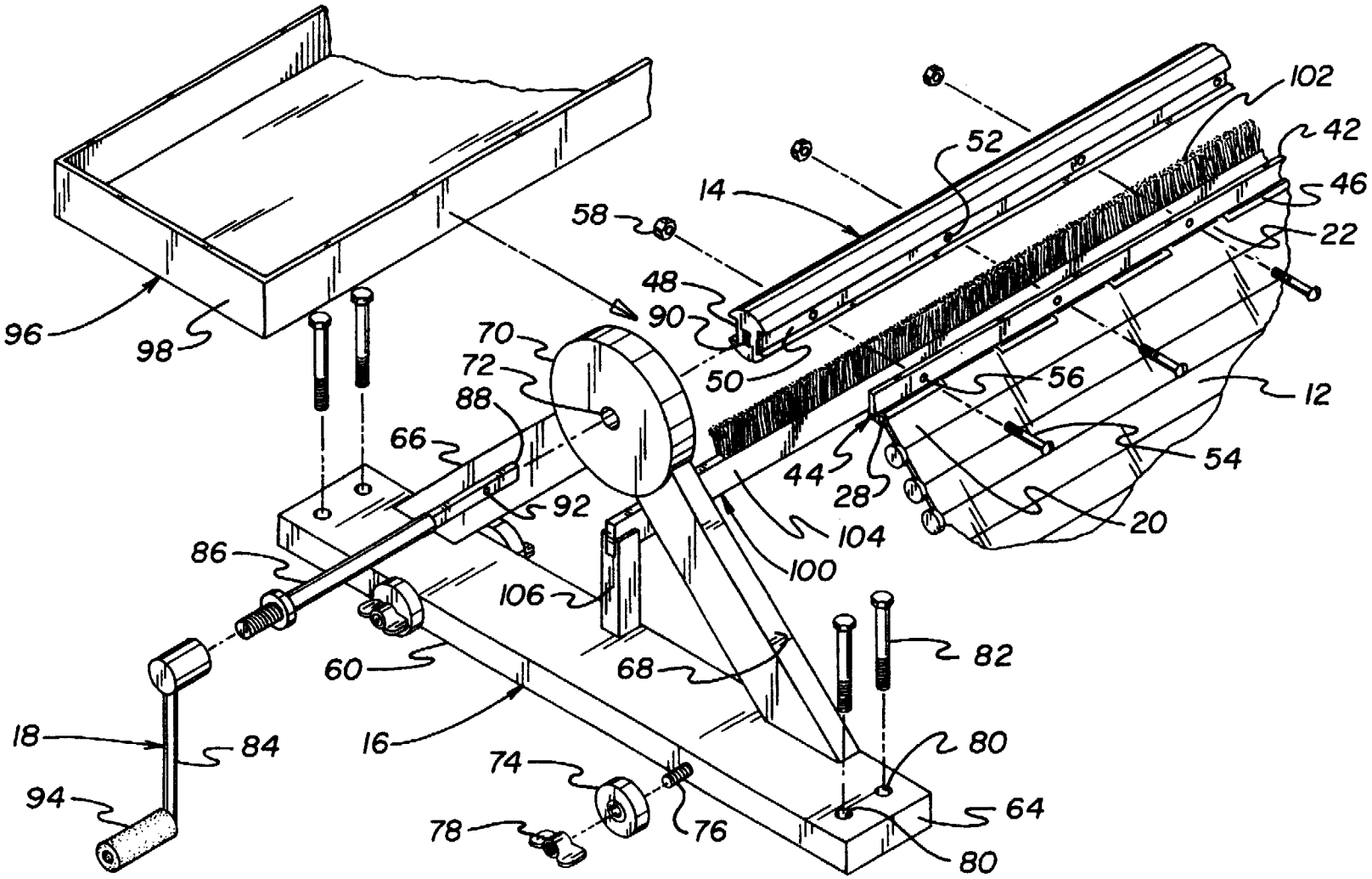
FIG. 2 is a partial exploded perspective view of the invention illustrating the method of assembly thereof.

As shown in FIG. 2, an elongated bar 42 is provided at an opposed end 44 of the pool cover 12, and the bar is provided with a plurality of spaced-apart conduits 46 which are interengagable with the conduits 22 formed on the slat 20 which lies against the bar. A final hinge rod 28 can be utilized to connect the bar 42 to the slat 20 at the end 44. The elongated roller 14 is of a substantially cylindrical design and would preferably be formed of a lightweight metal such as aluminum or the like. The roller 14 is provided with opposed flat surfaces 48, 50 which are countersunk into the roller, as illustrated in FIG. 2, and a plurality of apertures 52 extend through the roller and are centrally disposed in each of the flat surfaces 48, 50, whereby threaded connectors 54 can be directed therethrough. The bar 42 is provided with a plurality of through-extending apertures 56 which are alignable with apertures 52, whereby the threaded connectors 54 operably attach the bar 42 to the elongated roller 14 after internally threaded lock nuts 58 are connected to the connectors 54.

The portable support structure 16 comprises a pair of upstanding frame members 60, 62 which are disposed at opposite ends of the elongated roller 14 and which are therefor positionable on opposed sides of a swimming pool. The structures 60, 62 are substantially identical in construction and accordingly, only the structure 60 will be described in detail with it being understood that such description applies equally to the frame member 62.

The frame structure 60 includes a base member 64 having a pair of upstanding angularly directed supports 66, 68 affixed thereto, and the supports 66, 68 are further fixedly secured to a circular roller support 70 having a centrally positioned through-extending aperture 72. The frame structure 60, as well as the frame structure 62, is designed for portable movement by having the base 64 supported off of a ground surface by a plurality of wheels, all of which are generally designated by the reference numeral 74. Each wheel 74 is rotatably mounted over an externally threaded axle 76, and an internally threaded thumb nut 78 is threadably engagable with the axle 76 so as to maintain each wheel 74 in rolling engagement therewith. Once the frame structure 60 has been positioned where desired, an additional tightening of the thumb nut 78 will effect a locking of the wheel 74 whereby the portable support structure 16 is effectively lock against further movement. In those instances where it is not desired to occasionally move the portable support structure 16 to a storage location, the frame members 60, 62 can be permanently attached to a surface proximate the edge of a swimming pool, and such attachment is made possible by a plurality of through-extending apertures 80 in the base member 64. Conventional threaded bolts 82 can be directed through the apertures 80 so as to permanently secure each frame member 60, 62 into engagement with a surface proximate the edge of the pool.

The handle structure 18 can be used on one or both sides of the elongated roller 14 and essentially comprises a crank handle 84 which is threadably attachable to an elongate rod 86 which is of a conventional cylindrical design. A remaining free end 88 of the rod 86 is machined to a rectangular configuration and may be directed through the aperture 72 so as to be engagable with a rectangularly shaped aperture 90 formed in an end of the elongate roller 14. The rectangularly shaped end 88 of the rod 86 is further provided with a through-extending aperture 92 that is alignable with one of the apertures 52 and the elongate roller 14 so that a threaded connector 54 can be used to permanently attach the handle structure 18 to the roller. The outer curvilineral surface of the cylindrical portion of the rod 86 is slidably rotatably movable within the apertures 72 and a bearing surface exists therebetween so that a rotatable movement of the handle 84 effects a concurrent rotatable movement of the elongate roller 14 without any appreciable torque applied to the frame structure 60. The handle 84 is shown with a cushioned grip 94 and if desired, a bicycle handle-type grip could be employed wherein individual finger slots would provide greater comfort and ease of use.

Another novel feature of the present invention 10 involves the use of a debris removal and collection assembly which is generally designated by the reference numeral 96. The debris removal and collection assembly includes an elongate pan member 98 which is positionable beneath the roller 14 as best illustrated in FIG. 1. The pan extends over the entire length of the roller and is normally positionable beneath a debris deflector 100 as shown in FIG. 2. The debris collector 100 can take many shapes and forms but in the preferred embodiment 10, it essentially comprises an elongated brush having flexible yet rigid bristles 102 which are projected upwardly from a bar 104 supported at its opposed ends by upstanding vertical supports 106. The pair of upstanding vertical supports 106, only one of which is shown in FIG. 2, are fixedly secured to the bases 64 associated with the frame structures 60, 62. The debris deflector 100 is positioned whereby the bristles 102 will continually brush against an exposed surface of the flexible cover 12 as it is rolled about the roller 14. Debris which accumulates on the cover 12 will be deflected therefrom by the brash bristles 102 and will drop downwardly into the removal pan 98. The debris collects in the pan 98 and periodically, the pan can be removed for cleaning whereby the debris can be properly disposed of.

The embodiment 10 of the invention as shown in FIGS. 1, 2 and 3 relate strictly to a roller-up version thereof. It is also with the intent and purview of the present invention to utilize fold-out covers which could be constructed of two sections joined together with hinges. When not in use, the sections could fold together for storage proximate the pool. To utilize them, they can be dragged over part of the pool and unfolded to cover the rest of the pool. This second version of the invention, along with the first embodiment 10, provides a second line of defense against injury to child, i.e., it would be provided with sufficient floatability and strength to support the weight of a child or adult who might accidentally fall in the pool, thereby the substantially eliminate the danger of accidental drowning. Recognizing that most pool covers are designed to prevent debris collection in a pool as well as to retain and collect heat therein, a solar version of the present invention is also within the intent and purview hereof and is intended to be encompassed by the claims appended hereto. In the solar version, the individual slats 20 could be formed of a transparent material whereby sunlight would be allowed to pass therethrough into the pool water with the slats then operating to prevent heat from escaping therefrom. The slats could include hollow enclosed interiors similar to the bubble-type solar collecting pool covers, and these captures air chambers provide an even greater insulation effect.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved combined swimming pool cover and rollup apparatus comprising:

a flexible cover for substantially covering a water surface of said swimming pool, said flexible cover comprising:

a plurality of hinge rods; and a plurality of flexible sections, each said section having a plurality of integral conduits centrally distributed along opposing edges to matably interleave with an opposing section to form a single elongated hinge sleeve, each said hinge sleeve for receiving one of said plurality of hinge rods for pivotally attaching said flexible sections together to form said flexible cover;

a rotatable elongated roller having an end of said flexible cover attached thereto;

portable support means for selectively supporting said elongated roller proximate an edge of said swimming pool;

a debris collection means for cleaning debris off of said flexible cover during a rolling thereof about said elongated roller and for collecting said debris for later disposal after said cover has been cleaned, said debris collection means further including a debris collection pan removably positionable beneath said elongated roller;

a debris deflector positioned in a juxtaposed relationship to said elongated roller, whereby a surface of said flexible cover to be cleaned will be continuously drawn over said debris deflector during a rolling of said flexible cover about said elongated roller, thereby to removably deflect debris from said flexible cover during said rolling; and handle means attached to said elongated roller and being operable to effect a rotational movement of said elongated roller to roll and unroll said flexible cover thereabout, whereby debris deflected from said flexible cover by said debris deflector is collected in said debris collection pan.

2. The new and improved combined swimming pool cover and roll-up apparatus as described in claim 1 wherein said debris deflector comprises an elongated brush positioned in a juxtaposed relationship to said elongated roller.

3. The new and improved combined swimming pool cover and roll-up apparatus as described in claim 1 wherein said portable support means comprises a first base attached to one end of said elongated roller and a second base attached to a second end of said elongated roller, said elongated roller be rotatably movable relative to said first and second bases.

4. The new and improved combined swimming pool cover and roll-up apparatus as described in claim 3 wherein said first and second bases are provided with ground engaging wheels, thereby to facilitate a selective portable movement of said elongated roller and said flexible cover to and from a location proximate said swimming pool.

5. The new and improved combined swimming pool cover and roll-up apparatus as described in claim 4 wherein said wheels on said first and second bases are selectively lockable against rotation, thereby to provide a means of securing said elongated roller and said flexible cover in a fixed location.

6. The new and improved combined swimming pool cover and roll-up apparatus as described in claim 1 and further including rollers positioned on opposed ends of said plurality of hinge rods, said rollers being rotatably engageable with opposed sides of said swimming pool so as to support a rolling movement of said flexible cover over said swimming pool.

7. The new and improved combined swimming pool cover and roll-up apparatus as described in claim 6 and further including debris collection means for cleaning debris off of said flexible cover during a rolling thereof about said elongated roller and for collecting said debris for later disposal after said cover has been cleaned.

8. The new and improved combined swimming pool cover and roll-up apparatus as described in claim 7 wherein said debris collection means includes a debris deflector positioned in a juxtaposed relationship to said elongated roller, whereby a surface of said flexible cover to be cleaned will be continuously drawn over said debris deflector during a rolling of said flexible cover about said elongated roller, thereby removably deflecting debris from said flexible cover.

9. The new and improved combined swimming pool cover and roll-up apparatus as described in claim 8 wherein said debris collection means further includes a debris collection pan removably positionable beneath said elongated roller, whereby debris deflected from said flexible cover by said debris deflector is collected in said debris collection pan.

10. The new and improved combined swimming pool cover and roll-up apparatus as described in claim 9 wherein said debris deflector comprises an elongated brush positioned in a juxtaposed relationship to said elongated roller.

11. The new and improved combined swimming pool cover and roll-up apparatus as described in claim 10 wherein said portable support means comprises a first base attached to one end of said elongated roller and a second base attached to a second end of said elongated roller, said elongated roller be rotatably movable relative to said first and second bases.

12. The new and improved combined swimming pool cover and roll-up apparatus as described in claim 11 wherein said first and second bases are provided with ground engaging wheels, thereby to facilitate a selective portable movement of said elongated roller and said flexible cover to and from a location proximate said swimming pool.

13. The new and improved combined swimming pool cover and roll-up apparatus as described in claim 12 wherein said wheels on said first and second bases are selectively lockable against rotation, thereby to provide a means of securing said elongated roller and said flexible cover in a fixed location.

* * * * *